US006069451A

United States Patent [19]

Hush et al.

[11] Patent Number: 6,069,451

[45] Date of Patent: May 30, 2000

[54] ANALOG TO PULSE WIDTH CONVERTER FOR FIELD EMISSION DISPLAYS

[75] Inventors: Glen E. Hush; Robert R. Rotzoll, both of Boise, Id.

[73] Assignee: Micron Technology, Inc., Boise, Id.

[21] Appl. No.: 08/991,094

[22] Filed: Dec. 15, 1997

Related U.S. Application Data

[63] Continuation of application No. 08/311,971, Sep. 26, 1994, abandoned, which is a continuation of application No. 08/060,111, May 11, 1993, abandoned.

[51] Int. Cl.[7] ..... G09G 3/10

[52] U.S. Cl. ..... 315/169.1; 315/164; 315/300; 315/302

[58] Field of Search ..... 315/302, 300, 315/209 R, 164.1, 164

[56] References Cited

U.S. PATENT DOCUMENTS 5,424,618 6/1995 Bertenshaw et al. ..... 315/324

*Primary Examiner*—Frank G. Font
*Assistant Examiner*—Reginald A. Ratliff
*Attorney, Agent, or Firm*—Ozer M. N. Teitelbaum; William R. Bachand; Robert J. Stern

[57] ABSTRACT

A field emission display ("FED") is disclosed having a gray scale range. Input into the FED, initially, is an analog signal input. The FED, by employing an analog to pulse width converter, subsequently converts the analog input to a pulse width output, the width of which directly correlates to the amplitude of the analog input signal. To achieve this design, the analog to pulse width converter comprises a sampler for sampling the analog signal at a predetermined frequency, thereby creating a plurality of samples corresponding to the input voltage. Further, the converter comprises means for holding each of the samples. The output of the holding means is subsequently coupled with a load responsive to the output of the holding means. In one embodiment of the present invention, this load comprises a voltage controlled resistance. The voltage controlled resistance can comprise a convertor for converting each of the samples to a current source and a load for creating a voltage ramp. The voltage ramp is subsequently input to a buffer for comparing the load output with a predetermined threshold. By this design, a pulse width signal is thereby created, the width of which ranges between a minimum and a maximum value, the minimum and the maximum values corresponding to the gray scale range.

49 Claims, 5 Drawing Sheets

ANALOG TO PULSE WIDTH CONVERTER FOR FIELD EMISSION DISPLAYS

CROSS REFERENCE TO RELATED APPLICATIONS

This application is a continuation of application Ser. No. 08/311,971 filed Sep. 26,1994, now abandoned, which is a continuation of application Ser. No. 08/060,111 filed May 11, 1993, now abandoned.

FIELD OF THE INVENTION

The present invention pertains to Field Emission Display (FED) devices. More particularly, the invention relates to a system for controlling the gray scale range brightness of a FED.

BACKGROUND OF THE INVENTION

Until recently, the cathode ray tube ("CRT") has been the primary device for displaying information. While having sufficient display characteristics with respect to color, brightness, contrast and resolution, CRTs are relatively bulky and power hungry. These failings, in view of the advent of portable laptop computers, has intensified demand for a display technology which is light weight, compact, and power efficient.

One available technology is flat panel displays, and more particularly, Liquid crystal Display ("LCD") devices. LCDs are currently used for laptop computers. However, these LCD devices provide poor contrast in comparison to CRT technology. Further, LCDs offer only a limited angular display range. Moreover, color LCD devices consume power at rates incompatible with extended battery operation. In addition, a color LCD type screen tends to be far more costly than an equivalent CRT.

In light of these shortcomings, there have been several developments recently in thin film, Field Emission Display (FED) technology. FEDs utilize an array of pointed, thin film, cold field emission cathodes in combination with a phosphor luminescent screen. Extensive research has recently made the manufacture of an inexpensive, low power, high resolution, high contrast, full color FED a more feasible alternative to LCDs.

In order to achieve the advantages of this technology, as in the performance of LCDs, FED devices require a gray scale range control scheme. Several techniques have been proposed to control the brightness and gray scale range. For example, inventor Dunham in U.S. Pat. No. 5,103,144, and inventor Doran in U.S. Pat. No. 5,103,145, teach methods for controlling the brightness and luminance of flat panel displays. However, there remains a need for a gray scale range control scheme that requires less power and is simpler to manufacture. Further, a need exists for a gray scale control scheme requiring less circuitry and thus less surface area on a silicon die.

SUMMARY OF THE INVENTION

A primary object of the present invention is to eliminate the aforementioned drawbacks of the prior art.

In order to achieve these hereinabove objects, as well as others which will become apparent hereafter, a field emission display ("FED") is disclosed having a gray scale range. Input into the FED, initially, is an analog signal input. The FED, by employing an analog to pulse width converter, subsequently converts the analog input to a pulse width output, the width of which directly correlates to the amplitude of the analog input signal. To achieve this design, the analog to pulse width converter comprises a sampler for sampling the analog signal at a predetermined frequency, thereby creating a plurality of samples corresponding to the input voltage. Further, the converter comprises means for holding each of the samples. The output of the holding means is subsequently coupled with a load responsive to the output of the holding means. In one embodiment of the present invention, this load comprises a voltage controlled resistance. The voltage controlled resistance can comprise a buffer for converting each of the samples to a current and a load for creating a voltage ramp. The voltage ramp is subsequently input to a comparator for comparing the load output with a predetermined threshold.

By this design, a pulse width signal is thereby created, the width of which range between a minimum and a maximum value, the minimum and the maximum values corresponding to the gray scale range.

In a second embodiment, a counter is the means for controlling the pulse width. Input into the FED is an analog signal input, which is converted to a digital signal having a rising and a falling edge by means of an analog to digital converter. This digital signal is then input to a means for delaying the falling edge of the digital signal according to a number of periods, the number of periods being responsive to the analog signal's amplitude. This means for delaying the falling edge of the digital signal can be realized by a down counter. The counter comprises a reset for establishing the number of periods the counter is to count down from.

In still a further embodiment of the present invention, means are included for adjusting the gray scale range of the FED to provide contrast to the display.

In still a further embodiment of the present invention, a sensor is also included for sensing ambient light surrounding the FED, and means for modifying the pulse height in response to the ambient light sensor.

Other objects and advantages will become apparent to those skilled in the art from the following detailed description read in conjunction with the appended claims and the drawings attached hereto.

DETAILED DESCRIPTION OF THE PREFERRED EMBODIMENTS

Figure 1:
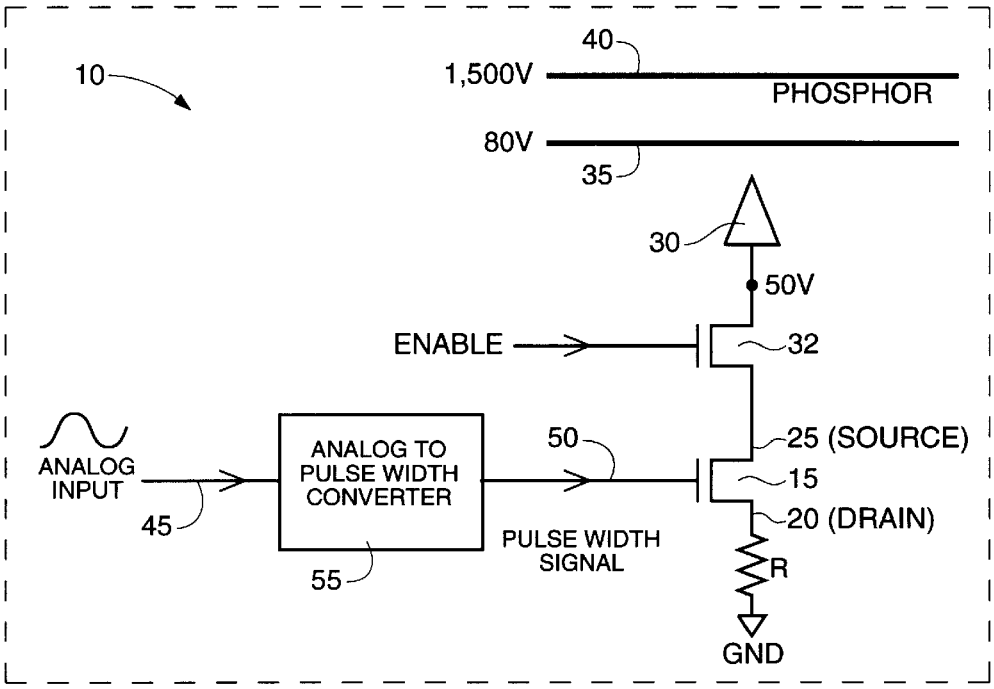
FIG. 1 is a schematic diagram of a field emission display device employing the present invention.

Referring to FIG. 1, a FED device 10 employing the present invention is shown. FED device 10 comprises a field effect transistor ("FET") pixelator 15 having a drain 20 which is coupled to ground and a source 25 which is coupled to a emitter tip 30. Further, coupled between source 25 and emitter 30 is a FET device 32 which is employed as an enable/disable switching device. It should be noted that the voltage potential from the emitter tip 30 to ground should be sufficiently high so as to properly operate emitter tip 30. In one embodiment, this voltage potential is approximately 50 volts. However, it should be obvious to one of ordinary skill in the art that the emitter tip is functional at other predetermined voltages.

Emitter tip 30 is positioned in a vacuum near a first and second grid plate, 35 and 40, respectively. Both grid plates are biased, such that first grid plate 35 has a substantially lower voltage than second grid plate 40. In one embodiment, first grid plate 35 has a voltage of 80 volts, while second grid plate 40 has a voltage of 1500 volts. However, it should be obvious to one of ordinary skill in the art that these voltages can be varied without adversely affecting the overall functionality of FED device 10, so long as first grid plate 35 is substantially lower than second grid plate 40.

The voltage differential between grid plates 35 and 40 causes an electron to be emitted from emitter tip 30 and onto second grid plate 40. As second grid plate 40 comprises a phosphor background, the area of second grid plate 40 bombarded by the discharged electron is illuminated. FED 10 illuminates more brilliantly according to the number of electrons bombarding the phosphor background.

Given the direct relationship between the number of electrons bombarding the phosphor background and the luminance of the display, the present invention employs a pulse width signal scheme as an input to FET 15. In order to achieve this end, an analog signal input 45 is transformed into a pulse width signal 50 by means of an analog to pulse width convertor 55.

Figure 2A:
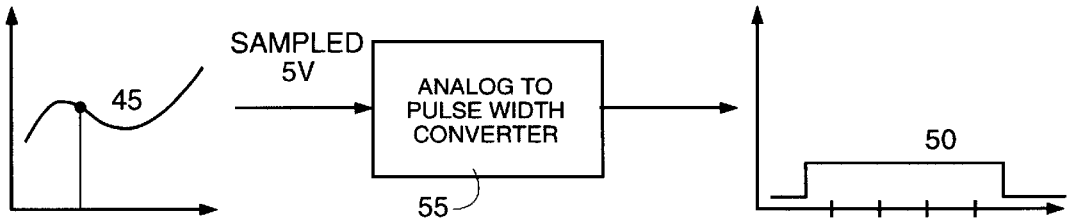
FIGS. 2(*a*) and (*b*) illustrates one aspect of the preferred embodiment of the present invention.
Figure 2B:
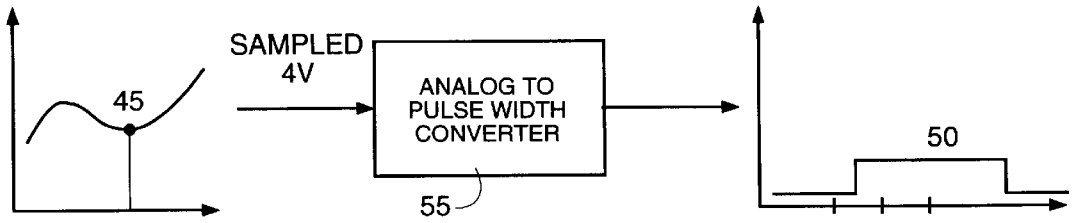

Referring to FIGS. 2(*a*) and (*b*), the effects of convertor 55 are illustrated. Analog signal input 45, upon being input to convertor 55, is sampled at a predetermined frequency. The value of the sampled analog signal input 45 is then transformed into a pulse whose width directly corresponds to the sampled voltage. For example, in FIG. 2(*a*), the first sampled voltage is 5 volts, which corresponds to a longer pulse width than that created by the second sampled voltage of 4 volts depicted in FIG. 2(*b*).

Figure 3:
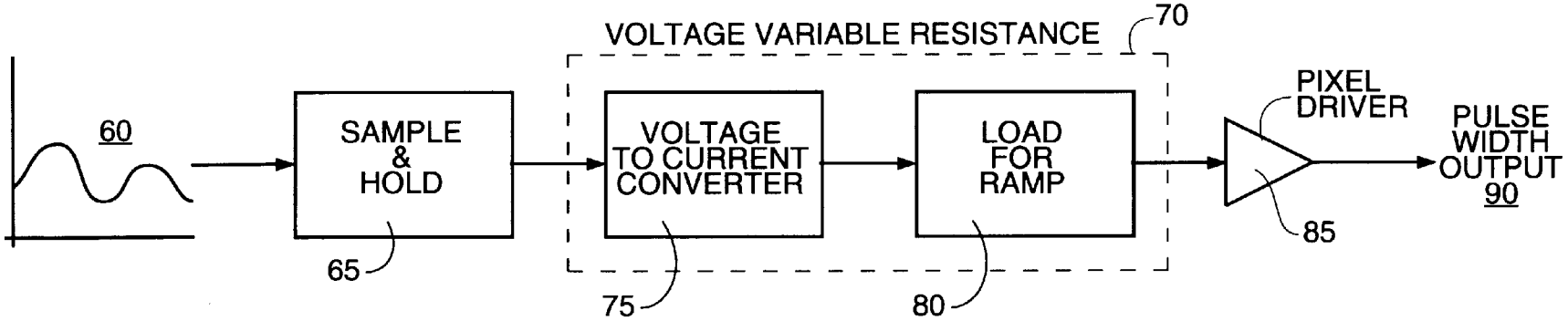
FIG. 3 illustrates, in block diagram format, the preferred embodiment of the present invention.

Referring to FIG. 3, a block diagram of the preferred embodiment of the present invention is shown, illustrating an analog to pulse width convertor. The purpose of the converter is to provide a means for controlling the gray scale range and brightness of an FED. Gray scale range is definable as the range between the minimum and said maximum width values of the pulse width signal.

Upon receiving an analog signal 60 comprising either a red, green and/or blue signal, in PAL signal or NTSC signal configuration, the present invention initially samples at a predetermined frequency and holds the input signal 60 by means of sample and hold circuitry 65. Minimally, this aspect of the invention can be achieved by a simple FET transistor coupled with a grounded capacitor to its drain. In principal, analog signal 60 is input into the source of the FET in order to create a sampler circuit.

Further, the capacitor is allowed to charge at a predetermined time constant to the sampled voltage, thereby creating a hold circuit.

Coupled to the output of sample and hold circuitry 65 is a voltage variable resistance 70. Voltage variable resistance 70 comprises two independent functional purposes. First, voltage variable resistance 70 converts the output of sample and hold circuitry 65 into a current source by means of a voltage to current converter 75. This, for example, can be realized by a current mirror circuit. Nonetheless, one of ordinary skill in the art may devise feasible alternatives.

Second, voltage variable resistance 70 comprises a load 80. The purpose of load 80 is to provide a ramped output for the next stage of the analog to pulse width converter. Load 80 can be realized simply as an integrator, such as a capacitor having a predetermined time constant, though one of ordinary skill in the art may devise viable alternatives. Once load 80 charges to a predetermined value, it subsequently discharges its stored energy.

Coupled to load 80 is a pixel driver or buffer 85. Pixel driver 85 serves the functional purpose of comparing the ramped load output with a predetermined threshold. This comparing feature thereby creates a pulse width signal output 90.

Figure 4A:
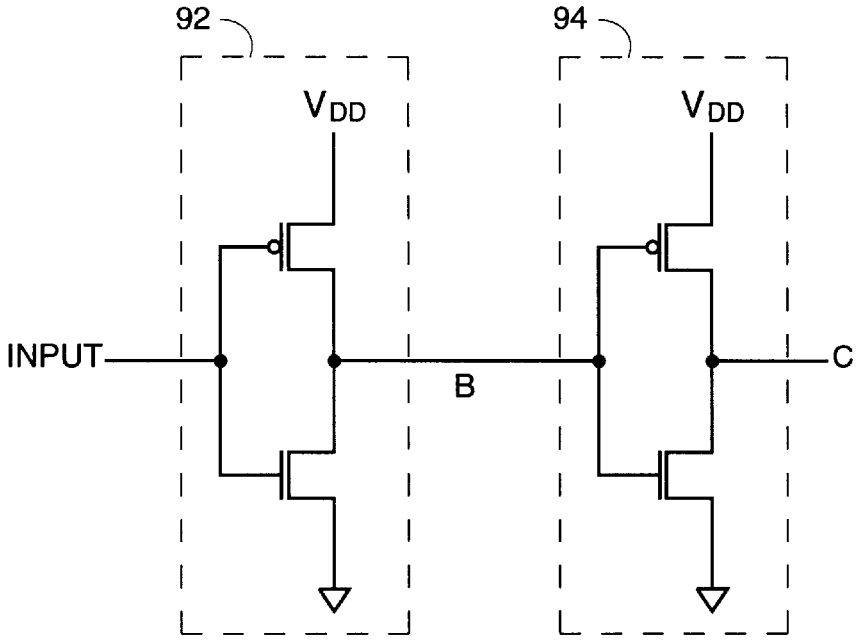
FIGS. 4(*a*) and (*b*) illustrate the final stage of the present invention and its output characteristics.
Figure 4B:
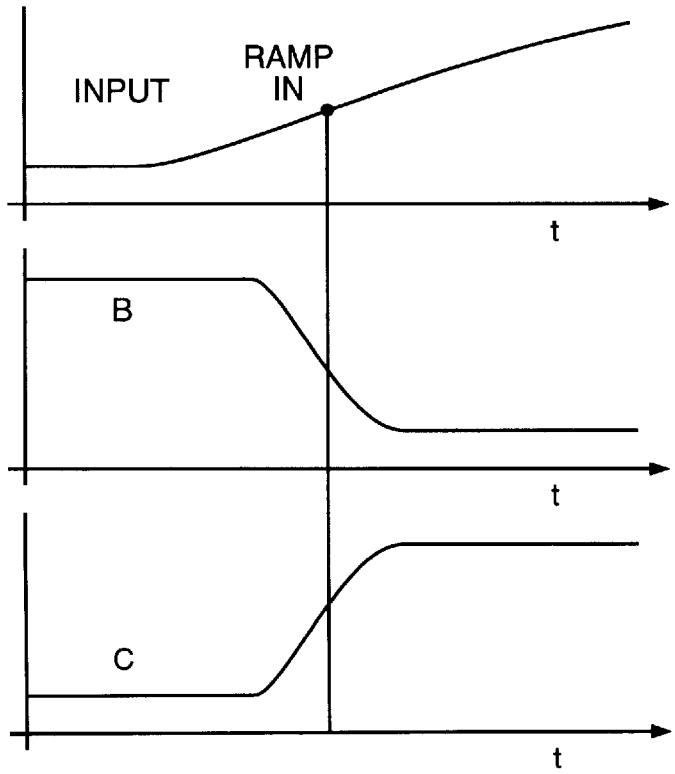
Figure 5A:
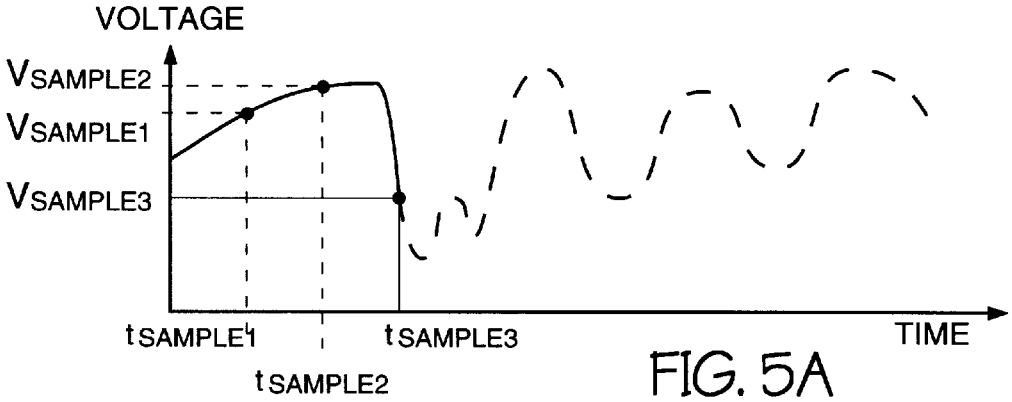
FIGS. 5(*a*)–(*d*) are illustrations of the output of each stage of the preferred embodiment of the present invention.
Figure 5B:
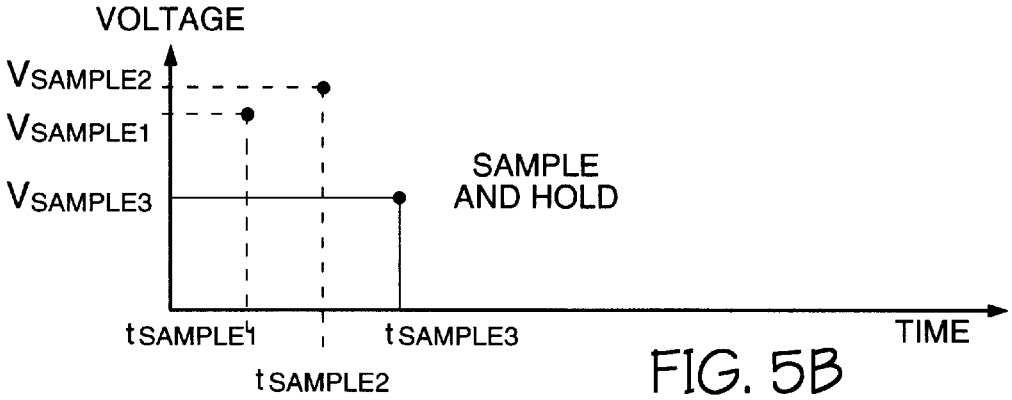
Figure 5C:
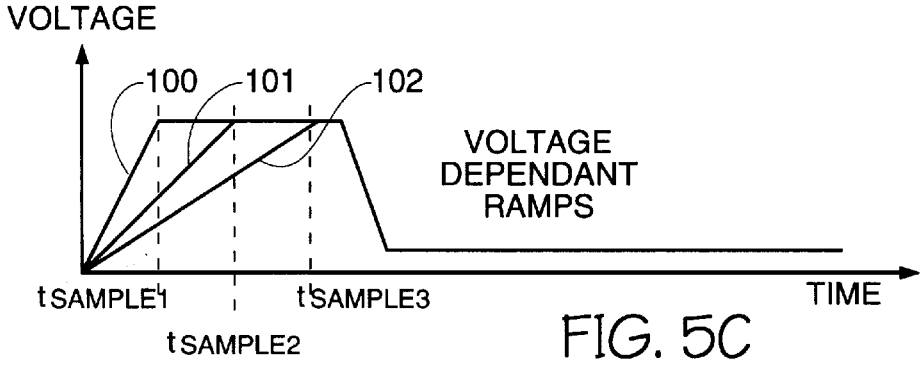
Figure 5D:
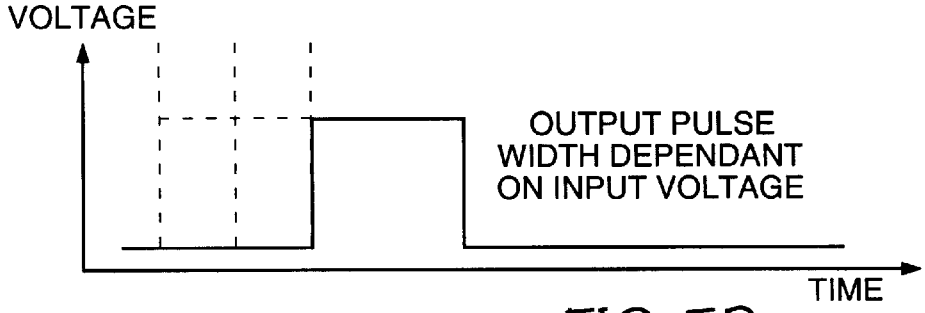

Referring to FIG. 4(*a*), a first realization of a pixel driver 85 is shown. Driver 85 essentially comprises two complementary metal oxide semiconductor ("CMOS") inverter devices, 92 and 94. Receiving the ramped output from load 80 as an input to driver 85, as shown in FIG. 4(*b*), an inverted output with an associated time constant is generated by CMOS inverter 92. Subsequently, the output propagated by inverter 92 is input and inverted by inverter 94 with an associated time constant. With respect to driver 85, a voltage threshold level exists along its output. This threshold level pertains to the trip point to which the output pulse width signal is to be deemed high or low.

Referring to FIGS. 5(*a*)–(*d*), the outputs of each stage of the preferred embodiment of the present invention are shown. With respect to FIG. 5(*a*), analog signal 60 is input to the present invention. Analog signal 60 is sampled at a predetermined frequency. For example, at times $t_{sample1}$, $t_{sample2}$, and $t_{sample3}$, voltages $V_{sample1}$, $V_{sample2}$, and $V_{sample3}$ are sampled from analog signal 60. FIG. 5(*b*) depicts the outputs of sample and hold circuitry 65 with respect to voltages $V_{sample1}$, $V_{sample2}$ and $V_{sample3}$.

As the output of sample and hold circuitry 65 is directly coupled to voltage variable resistance 70, a series of voltage dependent ramps are generated. FIG. 5(*c*) depicts three voltage dependent ramps, 100, 101, and 102. The ramps 100, 101, and 102 are directly correlatable to their respective sampled voltages, $V_{sample1}$, $V_{sample2}$, and $V_{sample3}$.

FIG. 5(*d*) illustrates the pulse width signal output. Pixel driver 85, being coupled to voltage variable resistance 70, creates an output pulse signal for each sample. While the amplitude of the originally sampled analog signal 60 varies over time, the amplitude of each output pulse signal remains constant. However, the width of pulse width signal output 90 directly corresponds to said amplitude of sampled analog signal input 60.

Figure 6:
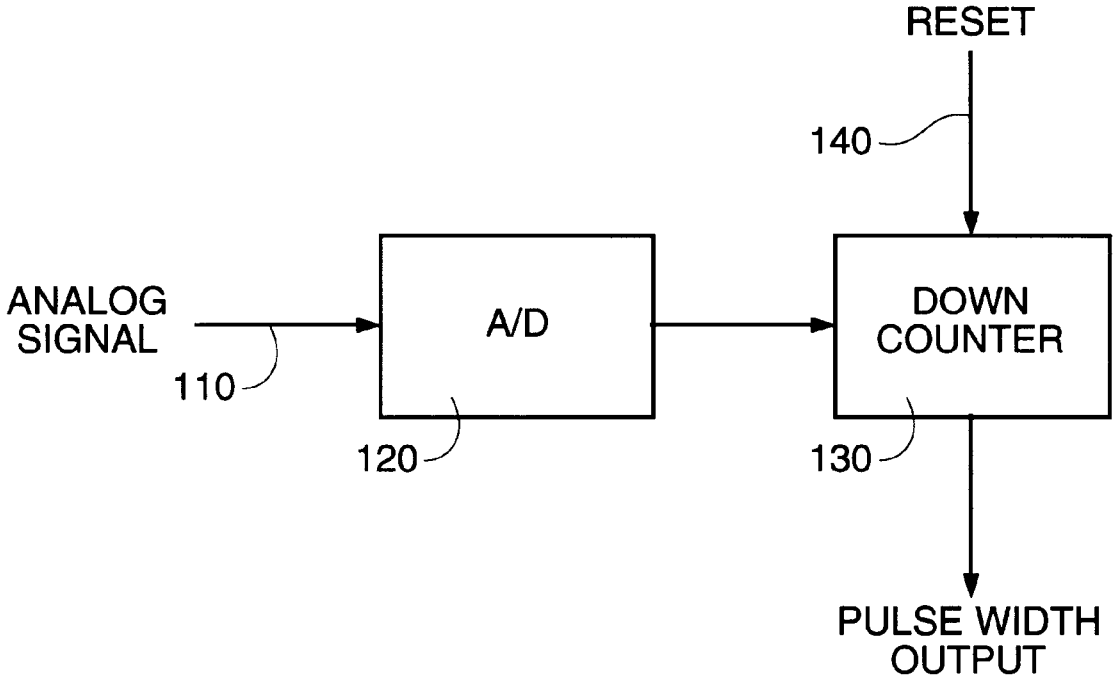
FIG. 6 illustrates a second embodiment of the present invention.

FIG. 6 illustrates a second embodiment of the present invention. In this embodiment, a counter scheme is employed as a means for controlling pixelator 15 of FIG. 1. Upon receiving an analog signal 110 comprising either a red, green and/or blue signal, PAL signal or NTSC signal configuration, the present invention performs an analog to digital ("AID") conversion by A/D converter 120. The resultant output of converter 120 is subsequently fed into a down counter 130. As a relationship exists between the number of electrons bombarding a phosphorus area and the brightness of a display pixel, counter 130 is employed for brightness and gray scale range control. Utilizing this format, counter 130 counts down a number from a certain number as a means for controlling the number of electrons which are to bombard the phosphorus region. In order to facilitate complete control over this scheme, a reset input 140 is input into counter 130 to establish the number of states or periods it must count down from. This number of states directly correlates to the width of the pulse width signal.

In a further embodiment of the present invention, means are provided for controlling the amplitude of the output pulse signal. This means increases or decreases amplitude of the output pulse signal. The functional purpose of this embodiment is to compensate for ambient light surrounding the FED. To facilitate this compensation, a sensor for sensing the ambient light is required, as is a means for amplifying the pulse height in response to the ambient light sensor's readings.

In still another embodiment of the present invention, a contrast control means is provided. As gray scale range is definable as the range between the minimum and said maximum width values of the pulse width signal, the contrast control means can expand or contract the gray scale range of the FED. To achieve this purpose, circuitry is provided to facilitate greater on demand ramping control. By doing so, the pulse width range can be expanded or contracted. This is primarily achieved by employing a control circuit over the voltage controlled resistance. It should be obvious to one of ordinary skill in the art that this can be realized by a variety of techniques.

While the particular invention has been described with reference to illustrative embodiments, this description is not meant to be construed in a limiting sense. It is understood that although the present invention has been described in a preferred embodiment, various modifications of the illustrative embodiments, as well as additional embodiments of the invention, will be apparent to persons skilled in the art upon reference to this description without departing from the spirit of the invention, as recited in the claims appended hereto. It is therefore contemplated that the appended claims will cover any such modifications or embodiments as fall within the true scope of the invention.

All of the U.S. Patents cited herein are hereby incorporated by reference in their entirety.

We claim:

1. A field emission display comprising:

at least one field emitter tip;

an analog input for receiving an analog video signal having an amplitude;

an analog-to-pulse width converter circuit for converting said video signal to a pulse signal having a pulse width responsive to said amplitude; and an emitter current control circuit which conducts an electrical current to the at least one field emitter tip in response to the pulse signal.

2. A field emission display according to claim 1, wherein:

said pulse width of the pulse signal ranges between a maximum value and a minimum value in response to a range of amplitudes of the video signal; and the analog-to-pulse width converter circuit further comprises a contrast control circuit for expanding and contracting the range between said maximum and minimum values for adjusting the contrast of said display.

3. A field emission display according to claim 1, further comprising:

an ambient light sensor; and means for modifying the amplitude of said pulse signal in response to said ambient light sensor.

4. A field emission display comprising:

at least one field emitter tip;

an analog input for receiving an analog video signal;

a sampler for sampling said video signal at a predetermined frequency creating a plurality of samples, each of said samples being characterized by a voltage;

a voltage-to-current converter circuit for transforming each successive sample voltage into a current;

an integrator for integrating said current, said integrator having an output; and a driver circuit for comparing said integrator output with a predetermined threshold so as to produce a pulse signal having a pulse width responsive to the video signal; and an emitter current control circuit which conducts an electrical current to the at least one field emitter tip in response to the pulse signal.

5. A field emission display according to claim 4, wherein said sampler comprises means for holding each of said samples.

6. A field emission display according to claim 4, wherein said voltage-to-current converter circuit comprises a current mirror circuit.

7. A field emission display having a gray scale range, comprising at least one field emitter tip;

an analog input for receiving an analog video signal having an amplitude;

a sampler for sampling said video signal at a predetermined frequency creating a plurality of samples;

means for holding each of said samples;

an analog to pulse width convertor circuit for converting each of said samples to a pulse signal, said pulse signal having a pulse height and pulse width, so that said pulse width is responsive to said amplitude of the video signal; and an emitter current control circuit which conducts an electrical current to the at least one field emitter tip in response to the pulse signal.

8. A field emission display according to claim 7, wherein:

said pulse width ranges between a minimum value and a maximum value in response to a range of amplitudes of the video signal, said minimum and maximum values corresponding to said gray scale range; and the convertor circuit further comprises a contrast control circuit for increasing and decreasing the contrast of the display by expanding and contracting, respectively, the range between said minimum and maximum values.

9. A field emission display according to claim 8, further comprising:

an ambient light sensor; and means for modifying said pulse height in response to said ambient light sensor.

10. A field emission display comprising:

at least one field emitter tip;

an analog input for receiving an analog video signal;

an analog to digital converter for converting said analog video signal to a digital signal;

a counter for counting a number of periods which is responsive to the digital signal and for producing a pulse signal, having a rising edge and a falling edge, so that the falling edge is delayed in proportion to said number of periods; and an emitter current control circuit which conducts an electrical current to the at least one field emitter tip in response to the pulse signal.

11. A field emission display according to claim 10, wherein said counter comprises a reset for establishing said number of periods.

12. A field emission display having a gray scale range, comprising:

at least one field emitter tip;

an analog signal input for receiving a video signal;

a sampler for sampling said video signal at a predetermined frequency creating a plurality of samples, each of said samples being characterized by a voltage;

means for successively holding each of said samples, said holding means having an output;

a load responsive to said output of said holding means, said load having a ramped output;

a buffer for comparing said load output with a predetermined threshold so as to create a pulse signal having a pulse width, the pulse width being between a minimum and a maximum value, said minimum and said maximum values corresponding to said gray scale range; and an emitter current control circuit which conducts an electrical current to the at least one field emitter tip in response to the pulse signal.

13. A field emission display having a gray scale range according to claim 12, wherein said load comprises a voltage controlled resistance.

14. A field emission display having a gray scale range according to claim 13, wherein:

said voltage controlled resistance comprises a voltage-to-current convertor for converting each of said samples to a current; and said ramped output is responsive to said current.

15. A field emission display having a gray scale range according to claim 12, further comprising a contrast control circuit for expanding and contracting the range between said maximum and minimum values of said gray scale range to adjust the contrast of said display.

16. A field emission display having a gray scale range according to claim 15, wherein:

said pulse signal is characterized by an amplitude; and said field emission display further includes an ambient light sensor, and means for modifying the amplitude of said pulse responsive to said ambient light sensor.

17. A field emission display having a gray scale range according to claim 14, wherein said voltage-to-current convertor comprises a current mirror circuit.

18. A field emission display having a gray scale range according to claim 12, wherein said holding means comprises a capacitor.

19. A display according to claim 1, wherein the emitter current control circuit comprises:

a transistor having a channel and a gate, wherein the channel is connected between the at least one emitter tip and a source of electrical current, and wherein the gate is connected to the control input of the emitter current control circuit.

20. A display according to claim 7, wherein the emitter current control circuit comprises:

a transistor having a channel and a gate, wherein the channel is connected between the at least one emitter tip and a source of electrical current, and wherein the gate is connected to the control input of the emitter current control circuit.

21. A method of controlling a field emission display in response to a video signal, comprising the steps of:

receiving an analog video signal having an amplitude;

converting the video signal to a pulse signal having a pulse width responsive to said amplitude; and supplying to at least one field emitter tip an amount of electrical current that is responsive to the pulse signal.

22. A method according to claim 21, wherein:

said pulse width of the pulse signal ranges between a maximum value and a minimum value in response to a range of amplitudes of the video signal; and the method of controlling a field emission display further comprises the step of adjusting the contrast of the display by expanding and contracting the range between said maximum and minimum values.

23. A method according to claim 21, further comprising the steps of:

sensing an ambient light level; and modifying the amplitude of said pulse signal in response to the sensed value of the ambient light.

24. A method of controlling a field emission display in response to a video signal, comprising the steps of:

receiving an analog video signal having an amplitude;

periodically sampling the video signal so as to create a plurality of successive samples;

converting each of said samples to a pulse signal having a pulse width responsive to the amplitude of the video signal; and supplying to at least one field emitter tip an amount of electrical current that is responsive to the pulse signal.

25. A method of controlling a field emission display in response to a video signal, comprising the steps of:

receiving an analog video signal;

periodically sampling the video signal so as to create a plurality of successive samples;

converting each sample to a digital signal having a value responsive to the video signal;

counting a number of periods which is responsive to the digital signal;

producing a pulse signal, having a rising edge and a falling edge, so that the falling edge is delayed in proportion to said number of periods; and supplying to at least one field emitter tip an amount of electrical current that is responsive to the pulse signal.

26. A field emission display having a pixel whose brightness varies in response to a video signal corresponding to that pixel, comprising:

a pixel including at least one field emitter tip;

an emitter current control circuit having a control input, wherein the emitter current control circuit conducts an electrical current to the at least one field emitter tip of the pixel in response to an electrical signal received at the control input;

a capacitor connected to the control input of the emitter current control circuit;

a video input for receiving the video signal for the pixel; and a charging circuit which supplies to the capacitor a current having a controlled value responsive to the video signal, so as to produce across the capacitor a voltage having a ramp waveform with a controlled slope responsive to the video signal.

27. A display according to claim 26, wherein the emitter current control circuit comprises:

a transistor having a channel and a gate, wherein the channel is connected between the at least one emitter tip and a source of electrical current, and wherein the gate is connected to the control input of the emitter current control circuit.

28. A field emission display according to claim 27, wherein the emitter current control circuit further comprises:

a resistor connected between the channel of the transistor and the source of electrical current.

29. A display according to claim 26, further comprising:

a sample-and-hold circuit connected between the video input and the charging circuit, wherein the sample-and-hold circuit periodically stores a sample of the video signal and supplies the stored sample to the charging circuit.

30. A display according to claim 26, further comprising:

a discharge circuit for periodically discharging the capacitor.

31. A display according to claim 26, further comprising:

a voltage comparator circuit, connected between the capacitor and the control input of the emitter current control circuit, which compares the voltage across the capacitor to a threshold voltage so as to provide to the control input of the emitter current control circuit a rectangular pulse signal which alternates between first and second distinct amplitudes, wherein the rectangular pulse signal has the first amplitude when the capacitor voltage is above the threshold voltage and has the second amplitude when the capacitor voltage is below the threshold voltage.

32. A field emission display comprising:

a plurality of pixels, wherein each pixel includes at least one field emitter tip;

an emitter current control circuit having a control input, wherein the emitter current control circuit conducts an electrical current to the at least one field emitter tip of the pixel in response to an electrical signal received at the control input;

a capacitor connected to the control input of the emitter current control circuit of the pixel;

a video input for receiving a video signal for the pixel; and a charging circuit which supplies to the capacitor of the pixel a current having a controlled value responsive to the video signal for the pixel so as to produce across the capacitor of the pixel a voltage having a ramp waveform with a controlled slope responsive to the video signal for the pixel.

33. A display according to claim 32, wherein each pixel further comprises:

a sample-and-hold circuit connected between the video input of the pixel and the charging circuit of the pixel, wherein the sample-and-hold circuit periodically stores a sample of the video signal for the pixel and supplies the stored sample to the charging circuit of the pixel.

34. A field emission display having a pixel whose brightness varies in response to a video signal corresponding to that pixel, comprising:

a pixel including at least one field emitter tip;

a transistor having a drain, a source, and a gate, wherein the source of the transistor is connected to the at least one field emitter tip;

a resistor connected between the drain of the transistor and a source of electrical current; and a pulse width converter circuit which receives the video signal and provides to the gate of the transistor a voltage pulse having a pulse width responsive to the video signal.

35. A display according to claim 34, wherein the pulse width converter circuit comprises:

a capacitor connected to the gate of the transistor; and a charging circuit which supplies to the capacitor a controlled current responsive to the video signal so as to produce across the capacitor a voltage ramp having a controlled slope responsive to the video signal.

36. A display according to claim 35, wherein the pulse width converter circuit further comprises:

a sample-and-hold circuit which periodically stores a sample of the video signal and supplies the stored sample to the charging circuit.

37. A display according to claim 35, wherein the pulse width converter circuit further comprises:

a discharge circuit which periodically discharges the capacitor.

38. A display according to claim 35, wherein the pulse width converter circuit further comprises:

a voltage comparator circuit, connected between the capacitor and the gate of the transistor, which compares the voltage across the capacitor to a threshold voltage so as to provide to the gate of the transistor a rectangular pulse signal which alternates between first and second distinct amplitudes, wherein the rectangular pulse signal has the first amplitude when the capacitor voltage is above the threshold voltage and has the second amplitude when the capacitor voltage is below the threshold voltage.

39. A field emission display comprising:

a plurality of pixels, wherein each pixel includes at least one field emitter tip;

a transistor having a drain, a source, and a gate, wherein the source of the transistor is connected to the at least one field emitter tip of the pixel;

a resistor connected between the drain of the transistor of the pixel and a source of electrical current;

a video input for receiving a video signal for the pixel; and a pulse width converter circuit which provides to the gate of the transistor of the pixel a voltage pulse having a pulse width responsive to the video signal.

40. A display according to claim 39, wherein each pixel further includes:

a sample-and-hold circuit connected between the video input of the pixel and the pulse width converter circuit of the pixel, wherein the sample-and-hold circuit periodically stores a sample of the video signal for the pixel and supplies the stored sample to the pulse width converter circuit of the pixel.

41. A method of controlling the brightness of a pixel of a field emission display in response to a video signal corresponding to that pixel, comprising the steps of:

providing at least one field emitter tip;

supplying to the at least one field emitter tip an electrical current whose value is responsive to an electrical signal received at a control input;

connecting a capacitor to the, control input; and supplying to the capacitor a current having a controlled value responsive to the video signal so as to produce across the capacitor a voltage having a ramp waveform with a controlled slope responsive to the video signal.

42. A method according to claim 41, wherein the step of supplying current to the at least one field emitter tip further comprises the steps of:

providing a transistor having a channel and a gate;

connecting the transistor channel between the at least one emitter tip and a source of electrical current; and connecting the transistor gate to the control input.

43. A method according to claim 42, wherein the step of supplying current to the at least one field emitter tip further comprises the step of:

connecting a resistor between the transistor channel and the source of electrical current.

44. A method according to claim 42, further comprising the step of:

periodically discharging the capacitor.

45. A method according to claim 41, further comprising the steps of:

comparing the voltage across the capacitor to a threshold voltage so as to produce a rectangular pulse signal which has a first amplitude when the capacitor voltage is above the threshold voltage and which has a second amplitude when the capacitor voltage is below the threshold voltage; and applying the rectangular pulse signal to the control input.

46. A method of controlling the brightness of a pixel of a field emission display in response to a video signal corresponding to that pixel, comprising the steps of:

providing at least one field emitter tip;

providing a transistor having a drain, a source, and a gate;

connecting the source of the transistor to the at least one field emitter tip;

connecting a resistor between the drain of the transistor and a source of electrical current;

producing a voltage pulse having a pulse width responsive to the video signal; and applying the voltage pulse to the gate of the transistor.

47. A method according to claim 46, wherein:

the step of producing a voltage pulse comprises supplying to a capacitor a current responsive to the video signal so as to produce across the capacitor a voltage ramp having a controlled slope responsive to the video signal.

48. A method according to claim 47, further comprising the step of:

periodically discharging the capacitor.

49. A method according to claims 47, wherein:

the step of producing a voltage pulse further comprises comparing the voltage across the capacitor to a threshold voltage so as to produce a rectangular pulse signal which has a first amplitude when the capacitor voltage is above the threshold voltage and which has a second amplitude when the capacitor voltage is below the threshold voltage; and the step of applying the voltage pulse comprises applying the rectangular pulse signal to the gate of the transistor.

* * * * *